US005996392A

United States Patent [19]

Garth

[11] Patent Number: 5,996,392

[45] Date of Patent: Dec. 7, 1999

[54] MACHINE FOR STAMPING, BENDING AND ASSEMBLY OF SHEET METAL PARTS

[75] Inventor: Harald Garth, Immenstadt, Germany

[73] Assignee: Krauss-Maffei AG, Munich, Germany

[21] Appl. No.: 09/259,513

[22] Filed: Feb. 26, 1999

Related U.S. Application Data

[63] Continuation of application No. 08/836,936, May 21, 1997, abandoned.

[30] Foreign Application Priority Data

Sep. 27, 1995 [DE] Germany ..... 195 35 949

[51] Int. Cl.[6] ..... B21J 9/18

[52] U.S. Cl. ..... 72/452.4; 72/384; 72/447; 72/449

[58] Field of Search ..... 72/452.4, 447, 72/442, 449, 384

[56] References Cited

U.S. PATENT DOCUMENTS

| | | | |
|---|---|---|---|
| 3,256,915 | 6/1966 | Fisher, Jr. et al. | 72/449 |
| 3,296,851 | 1/1967 | Breuer | 72/449 |
| 4,580,329 | 4/1986 | Bihler et al. | 72/442 |
| 4,696,178 | 9/1987 | Bihler . | |
| 4,708,009 | 11/1987 | Post | 72/452.7 |
| 4,862,717 | 9/1989 | Dolliner | 72/447 |
| 5,271,261 | 12/1993 | Bihler et al. . | |

FOREIGN PATENT DOCUMENTS

| | | |
|---|---|---|
| 0103885 | 3/1984 | European Pat. Off. . |
| 2618846 | 11/1977 | Germany . |
| 01 27 156 A2 | 5/1984 | Germany . |
| 35 782 | 8/1984 | Germany . |
| 32 34 981 C2 | 6/1986 | Germany . |
| 40 27 900 A1 | 3/1992 | Germany . |

*Primary Examiner*—David Jones
*Attorney, Agent, or Firm*—Henry M. Feiereisen

[57] ABSTRACT

A stamping and bending machine (10) has upper and lower horizontal supports (18, 16) in each of which are formed two longitudinal chambers (80) which open out through broad longitudinal slits (86) on opposite sides of the horizontal supports (16, 18). On both lateral faces of the horizontal supports (16, 18) carriage assemblies (26) are fixed; each of these carries an angular gear (36) which is encapsulated in a gear housing and protrudes through the longitudinal slit (86) into the appropriate longitudinal chamber (80). The angular gears (36) in each longitudinal chamber (80) are provided with coaxial through-channels with polygonal profiles. A drive shaft (28) with matching polygonal profiles is inserted through the angular gear (36) of each longitudinal channel (80) and couples the carriage assemblies (26) together. All the bearings of the gear teeth of the angular gear (36) and output shaft in the carriage assembly (26) are arranged in the modular unit formed by the carriage assembly (26) and the angular gear (36). The drive shaft (28) is supported by the angular gear (36) and thus requires no bedding of its own in the horizontal supports (16, 18) of the machine housing (14).

10 Claims, 7 Drawing Sheets

MACHINE FOR STAMPING, BENDING AND ASSEMBLY OF SHEET METAL PARTS

Figure 2:
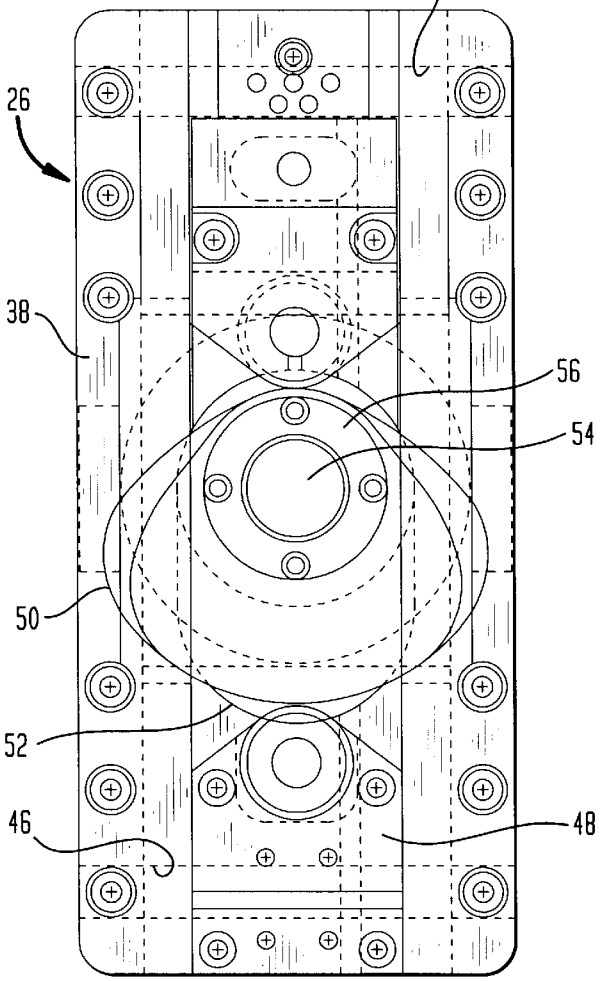

This is a continuation of patent application Ser. No. 08/836,936, filed May 21, 1997 now abandoned.

The invention relates to a machine for stamping, bending and assembly of sheet metal parts.

A machine of this type is known from EP-B-0103885. The gear housing is associated with the machine housing and the plug-in coupling is located between the drive gearwheel of the gear housing and the drive shaft of the carriage assembly. The carriage assembly is supported on the machine housing for lengthwise movement and can be bolted down in any translated position. Inside the machine housing, the gear housing is also provided with a guide for lengthwise movement and has to be secured separately in the desired translated position. The drive shaft is supported in the machine housing and is formed as a worm shaft, except for its ends. The drive gearwheel in the gear housing is therefore a worm wheel. The bearing arrangement of the rotating elements is expensive, requires precise adjustment and an expensive lubrication system, since the drive shaft in the machine housing, the drive gearwheel in the gear housing and the drive shaft in the carriage assembly are all supported separately.

In DE-A-2618846 there is depicted a stamping and bending machine wherein the drive shaft has a central bevel wheel. The carriage assembly has on its drive shaft also an bevel wheel which meshes with the central bevel wheel. Here, the two bevel wheels provide the drive coupling between the carriage assembly and the machine drive. In this machine, the carriage assemblies can only be disposed in the radial direction with respect to the central drive bevel wheel. Consequently, the possible number of carriage assemblies is limited, thereby limiting the general utility of the machine.

It is an object of the invention to simplify a machine of the aforementioned type, especially with respect to the support and the lubrication of the rotating elements and to lower the manufacturing cost of such a machine.

This object is solved by providing a machine for stamping, bending and assembly of sheet metal parts, which machine includes a housing supporting a drive shaft, carriage assemblies carrying a plurality of tools and attachable to the housing, wherein each of the carriage assemblies is provided with a drive shaft having at least one cam disc and a drive gear wheel, with the drive shaft in driving engagement with the drive shaft through the drive gear wheel by way of an angular gear disposed inside a gear housing, wherein the carriage assembly is releasable from the machine housing following the release of a rotatable plug-in coupling, wherein the angular gear is provided with a drive gear wheel supported in the gear housing coaxially with the drive shaft, wherein the gear housing forms a unit with the base plate of the carriage assembly and wherein the plug-in coupling is formed between the drive gear wheel and the drive shaft, with both the drive gear wheel and the drive shaft having complementary non-circular coupling sections.

The gear housing supports the drive gear wheel and the drive shaft to which the drive gear wheel is attached. The gear housing can be encapsulated and is permanently lubricated, thereby making a central lubrication of the machine unnecessary. The drive gear wheel is located on a hollow hub through which the drive shaft protrudes. Gear housings of this type can be manufactured inexpensively in series production. The drive shaft consists of a simple, polygonal profile section rod cut to proper length, wherein exact tolerances in the complementarily formed hollow hub are not important, since polygonal couplings of this type are self-centering.

In the machine of the invention, the base plates of the carriage assemblies are inserted into the longitudinal guides of the machine housing and bolted down at the desired translated positions. The gear housings which are fastened to the back side of the base plate, are thus oriented such that their hollow hubs extend along the longitudinal direction, so that the polygonal rod forming the drive shaft can only be inserted from a front face of the machine housing for driveably coupling the carriage assemblies. The drive shaft itself does not require its own bearing because it receives support from the angular gears of the carriage assemblies.

In a modification of the invention, the drive shaft is provided adjacent to its at least one coupling section with an idle-running section, wherein the drive shaft can be axially displaced relative to the carriage assembly up to a point where the idle-running section takes the place of the coupling section, wherein the greatest radial extent of the idle-running section is smaller than the smallest radial extent of the coupling section in the drive gear wheel. This coupling section is preferably formed in a subsection of a hollow hub extending over the entire length of the gear housing and supported at both ends, i.e. supported in the region of the drive gear wheel itself which is secured to the hollow hub proximate to one of its ends. In this embodiment, either the carriage assembly or the drive shaft or both elements can be moved for activating or deactivating the coupling engagement. It is also possible to disengage individual carriage assemblies of a series of carriage assemblies which can be easily accomplished by moving the drive shaft and which can be automated by way of an actuator disposed at one end.

The machine housing preferably consists of two spaced apart parallel horizontal support members connected by two vertical support members. The support members have an identical cross section over their entire length and may be formed as an extruded double-T profile having longitudinal chambers terminating at the opposite sides in comparatively wide longitudinal slots. The width of the longitudinal slots is identical to the dimension of the gear housing measured in the wide direction, since the gear housings are inserted through these longitudinal slots into the longitudinal chambers of the support members.

Figure 1:
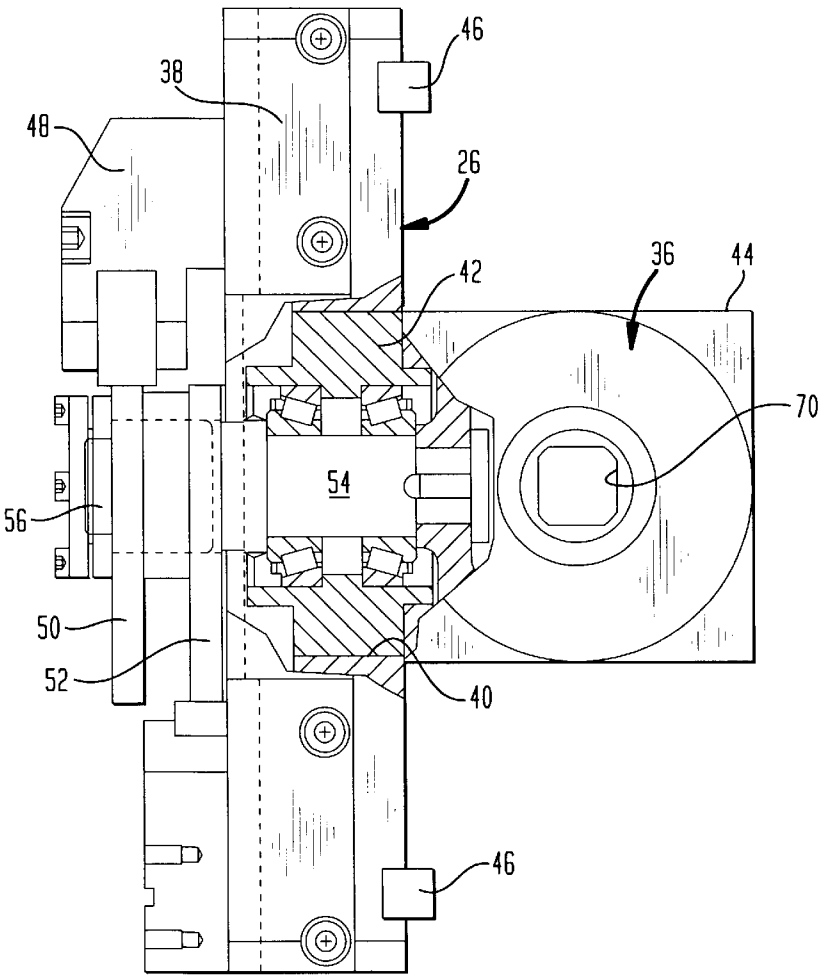
Figure 3:
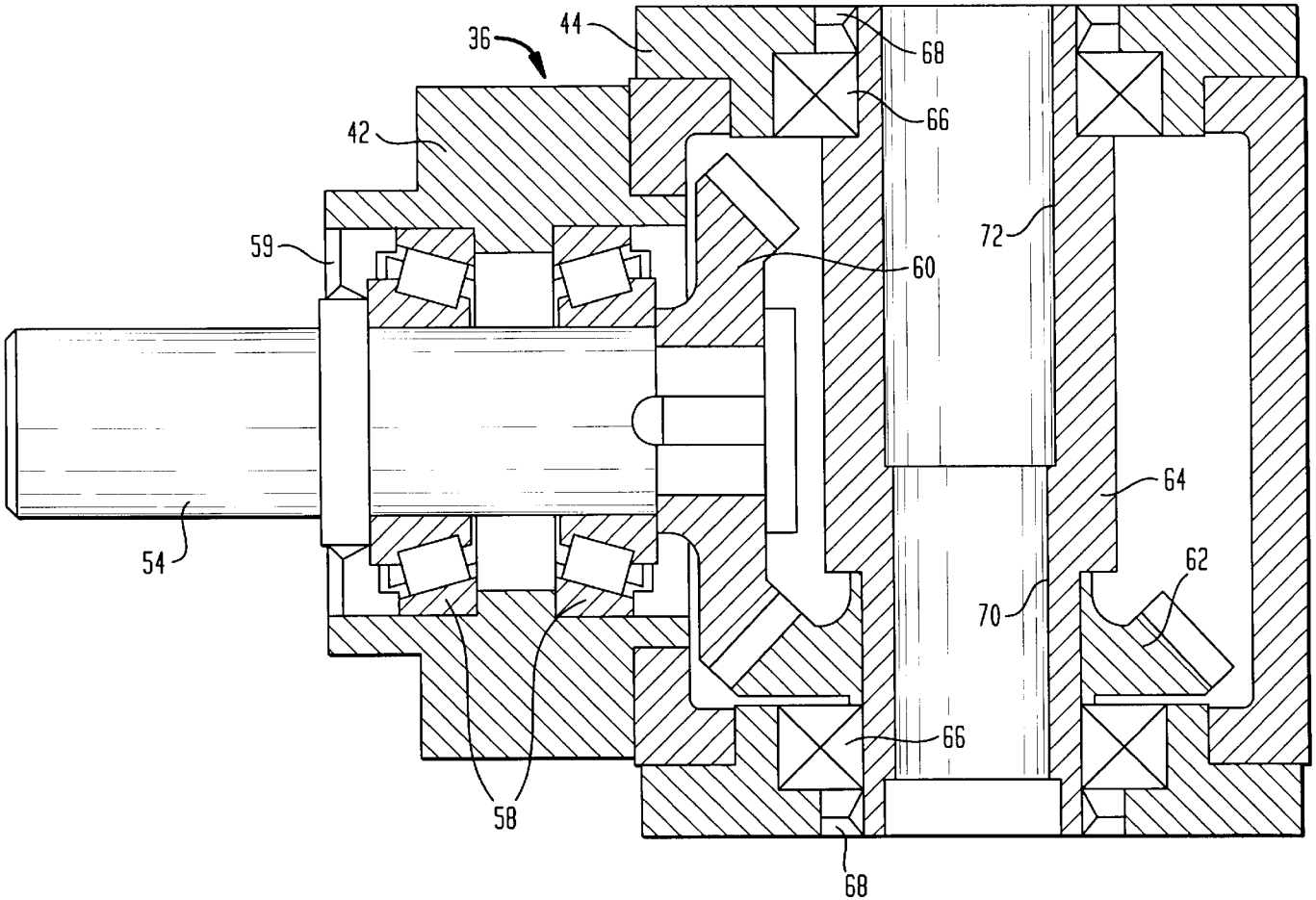
Figure 5:
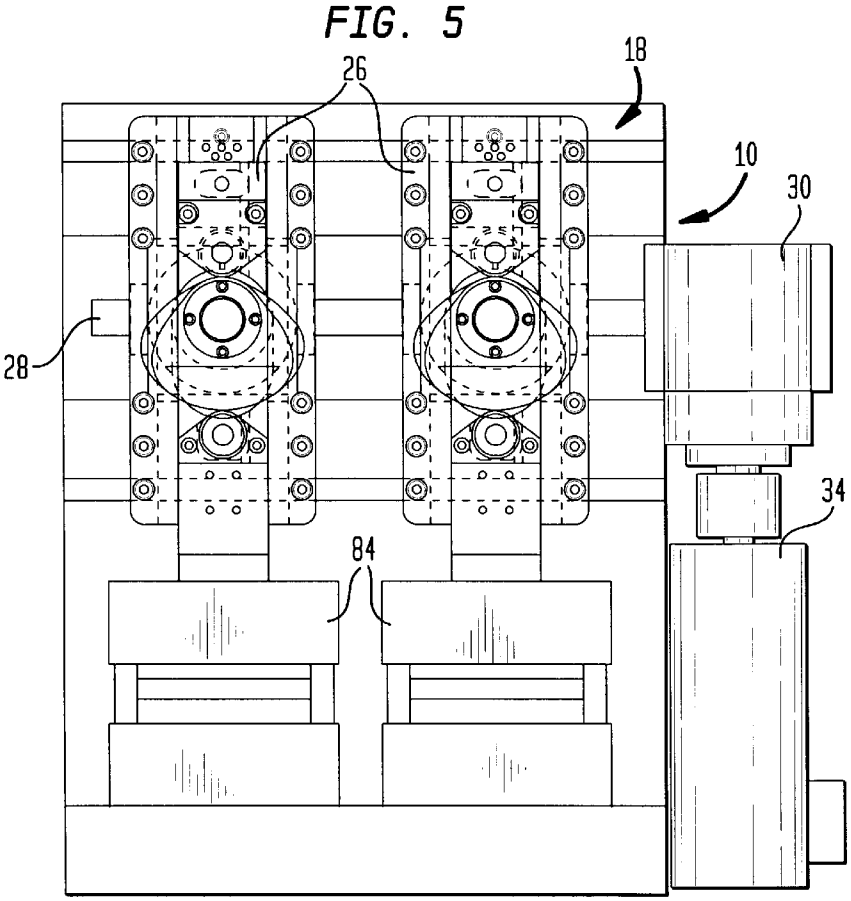
Figure 4:
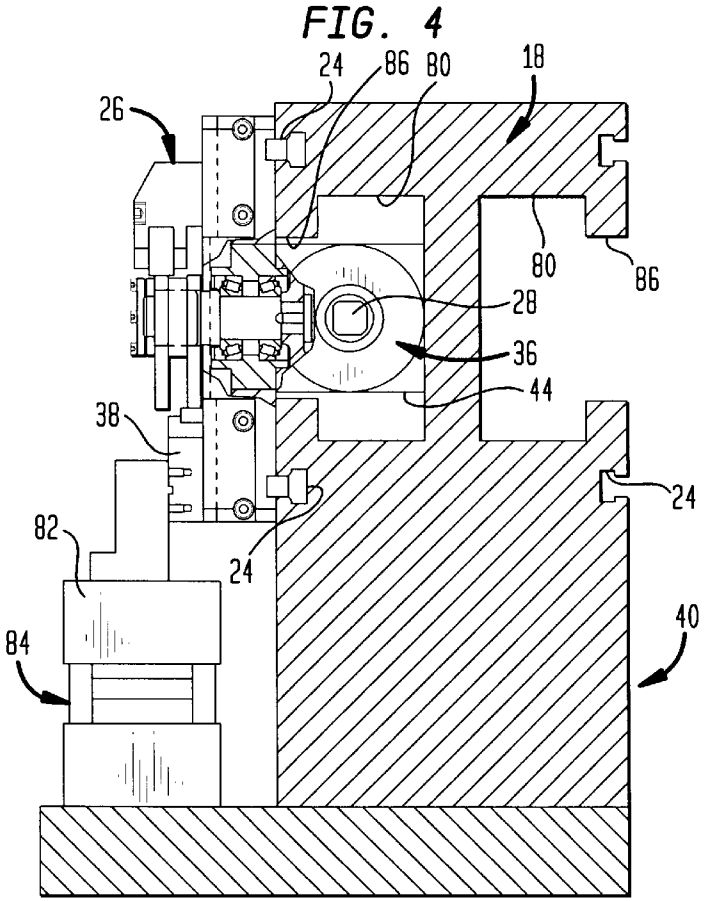
Figure 6:
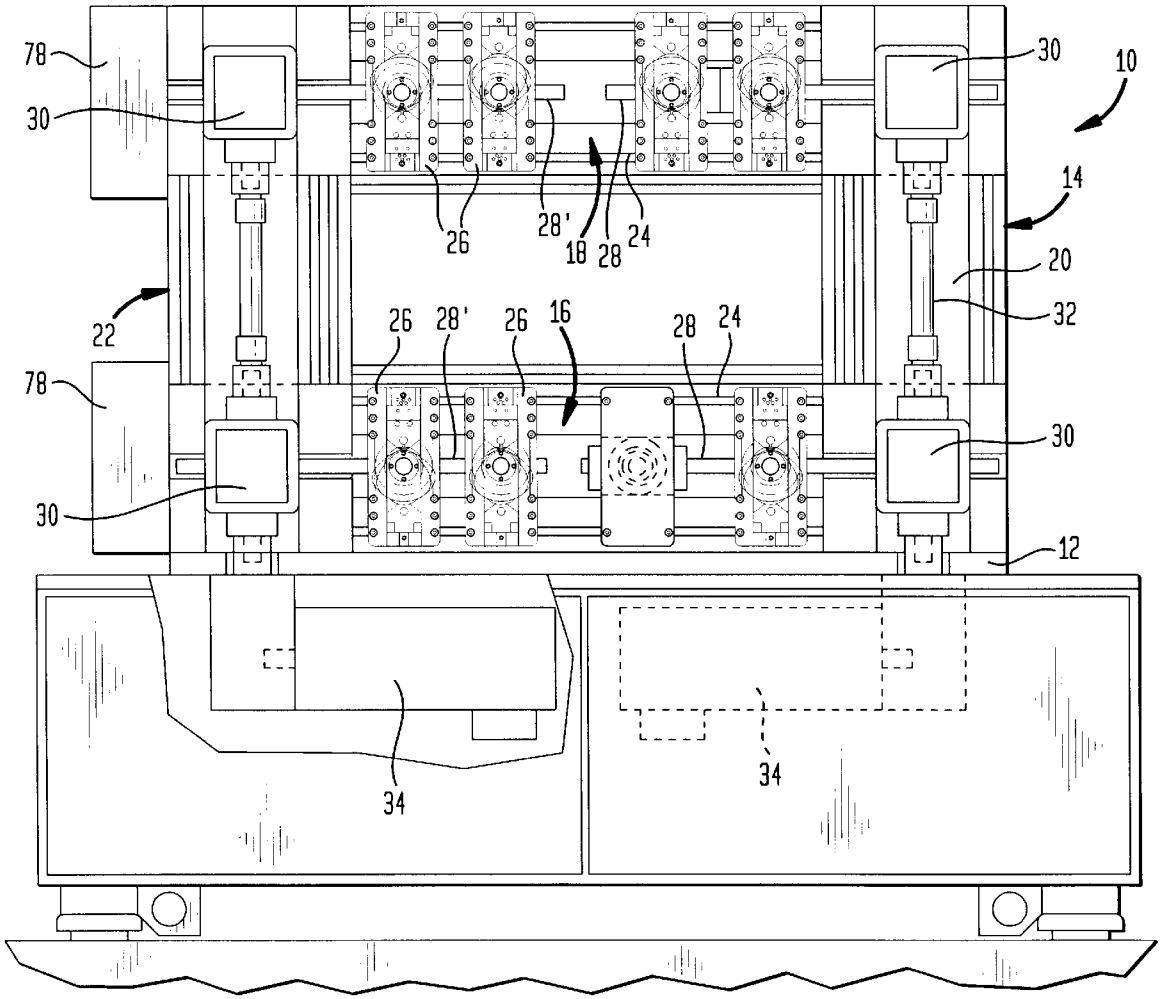
Figure 7:
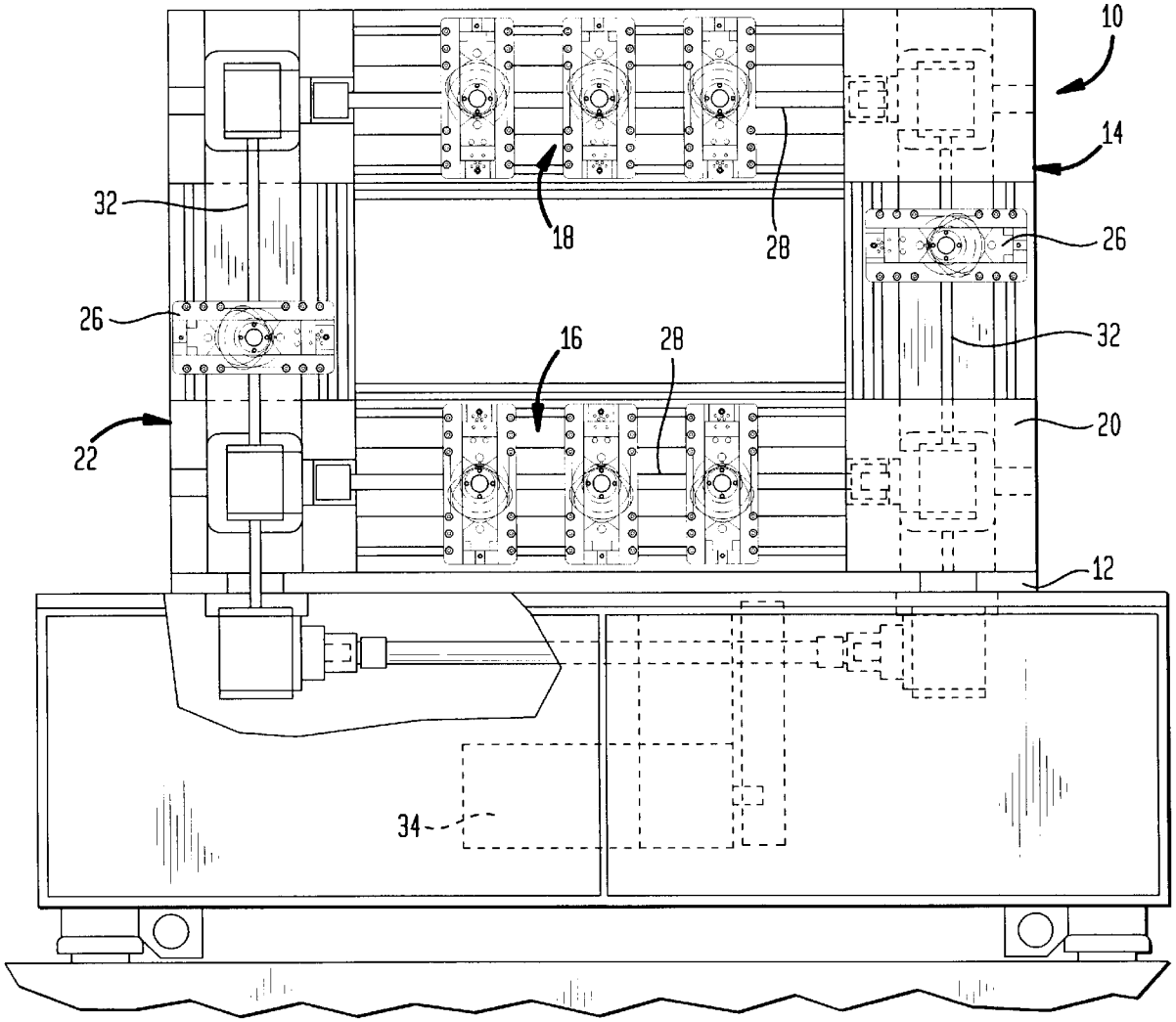
Figure 8:
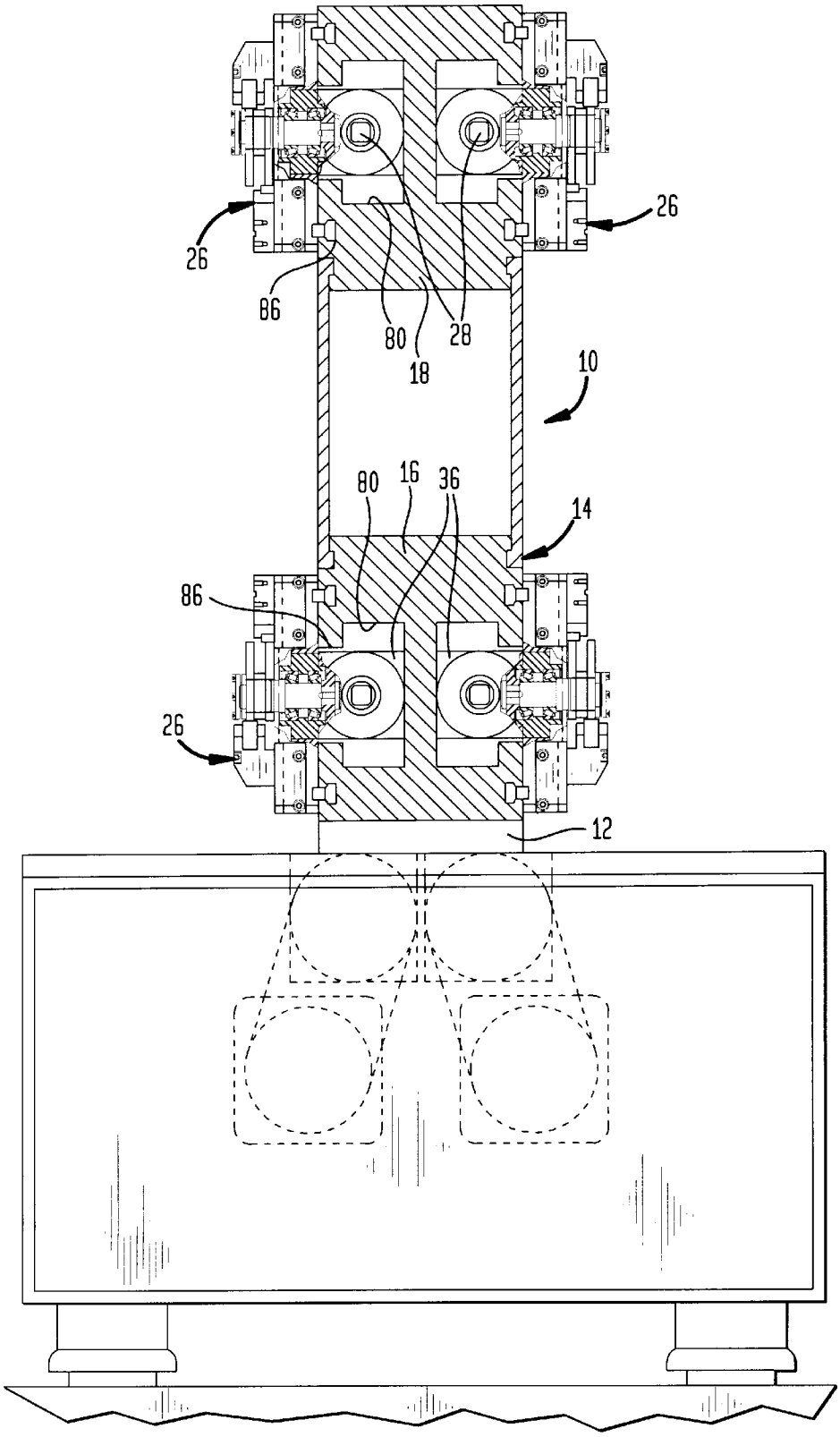
Figure 9:
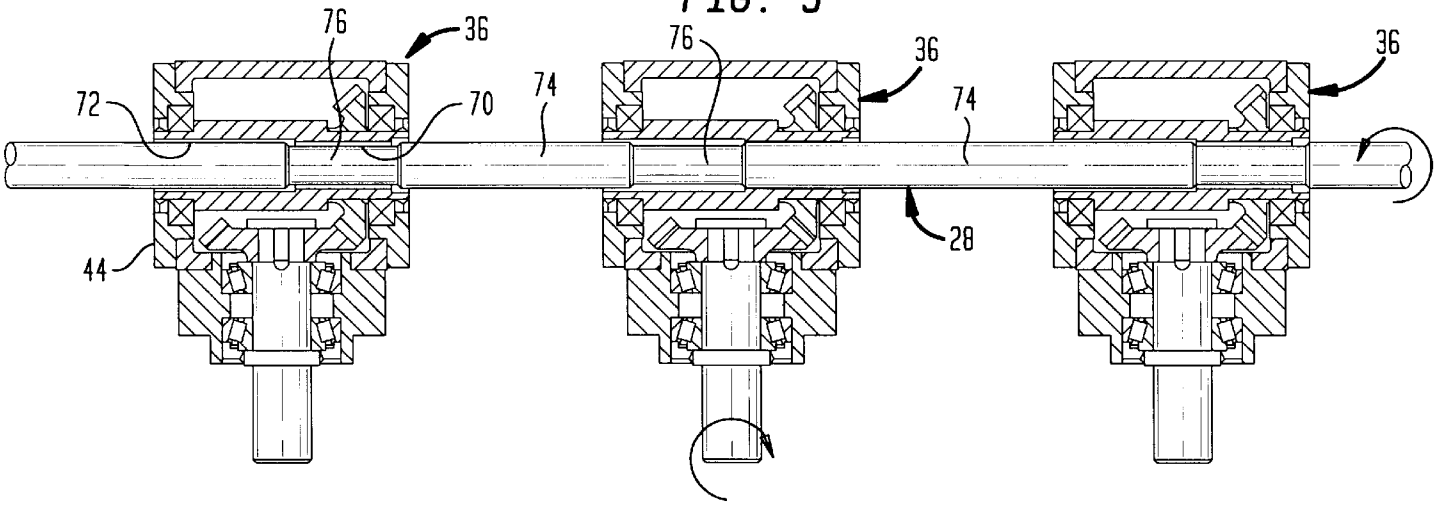
Figure 10:
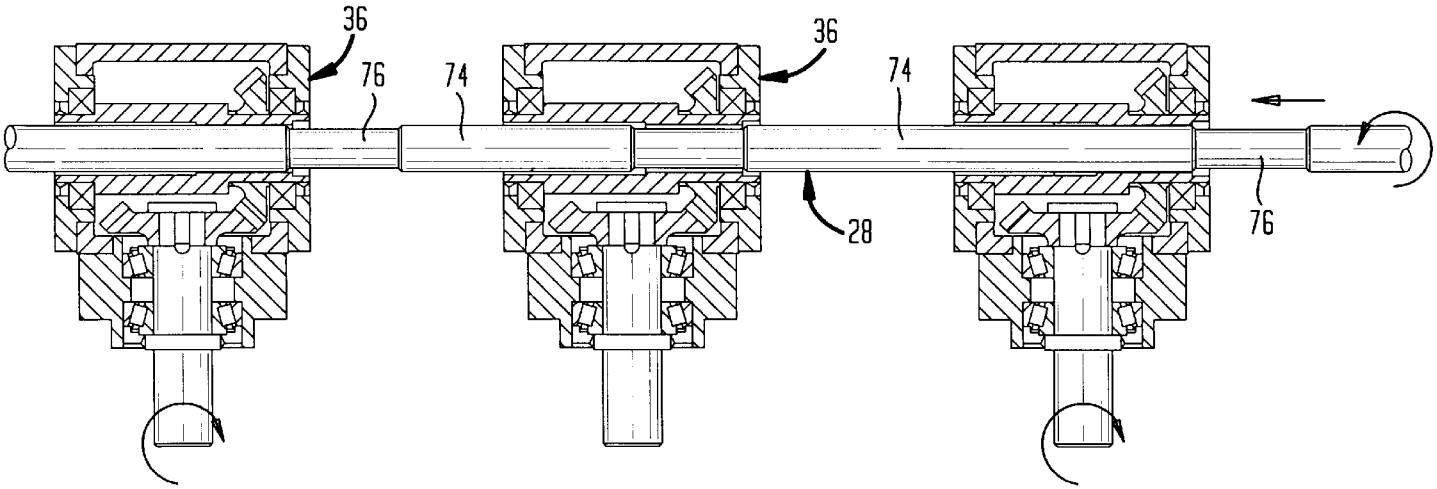

The invention will be discussed with reference to an example, taken in conjunction with the accompanying drawing, in which:

FIG. 1 shows a partial sectional side view of a carriage assembly with attached gear housing, FIG. 2 shows a front view of the carriage assembly of FIG. 1, FIG. 3 shows a sectional view through the gear housing with drive shaft for installation in a carriage assembly, FIG. 4 shows a sectional view through a first embodiment of a machine housing provided with a carriage assembly/gear housing assembly, FIG. 5 shows a front view of the machine housing of FIG. 4, FIG. 6 shows a front view of a modified embodiment of a machine provided with carriage assemblies, FIG. 7 shows a front view of a further modified machine which is, in addition, provided with left and right carriage assemblies, FIG. 8 shows a sectional view through the machine according to FIGS. 6 and 7, FIG. 9 shows a horizontal sectional view of several gear housings connected to each other by a common drive shaft, and FIG. 10 shows a sectional view similar to FIG. 9, but with the drive shaft axially displaced.

The basic construction of a stamping and bending machine is indicated in FIG. 6. The machine has a milled or ground mounting plate 12 with a machine housing 14 secured thereto. The machine housing 14 consists of a lower horizontal support member 16 and an identically constructed upper horizontal support member 18. The end faces of both horizontal support members 16, 18 are bolted to identically constructed vertical support members 20, 22. The horizontal support members 16, 18 are provided with upper and lower longitudinal keyways 24 on their front faces with moveable tenon blocks disposed therein for bolting down a number of carriage assemblies 26 to the support members 16, 18. The carriage assemblies 26 are driven by horizontal drive shafts 28, with each of the drive shafts 26 connected to an angular gear 30 secured to a vertical support member 20. Both angular gears 30 are driveably connected to each other by a vertical connecting shaft 32. The lower angular gear 30 in the vertical support member 20 includes an output shaft driveably connected to a drive motor 34 and protruding through the mounting plate 12, with the drive motor 34 secured to the underside of the mounting plate 12.

The machine 10 of FIG. 6 has the characteristic feature that the housing 14 is subdivided into a left half and a right half in such a way that individual drive shafts 28, 28' are associated with each of the halves, wherein each drive shaft 28, 28' is driveably coupled to a drive motor 34. The carriage assemblies 26 of the left half of the housing can therefore be driven with a different tact frequency than those of the right half of the housing.

In FIGS. 1 and 2, there is shown a novel assembly consisting of a carriage assembly 26 with an integrated angular gear 36. The carriage assembly 26 includes a base plate 38 with a stepped bore 40 accessible from the back side, in which a complementary collar 42 of a gear housing 44 of the angular gear 36 engages in a formfitting manner. The gear housing 44 is secured to the base plate 38 at the front of the base plate 38 with four screws. From the back of the base plate 38, there protrude upper and lower tracks 46 which extend over the width of the base plate 38 and engage in a formfitting manner in the keyways 24 of the two horizontal support members 16, 18 of the machine housing 14.

On the front of the base plate 38, there is located a carriage 48 which is driven in a known manner through cam discs 50, 52 which are secured by way of a cam disc carrier 56 positioned on the drive shaft 54 of the angular gear 36.

As best seen from FIG. 3, the gear housing 44 includes a projection which is formed by the stepped collar 42, and wherein there is provided a particularly sturdy bearing assembly 58 consisting of two axially spaced individual bearings for supporting the drive shaft 54 which carries inside the gear housing 44 a conical drive gear 60. The conical drive gear 60 meshes with a conical drive gear 62 located on a hollow hub 64, with the axis of the hollow hub 64 oriented perpendicular to the axis of the drive shaft 54 and extending over the entire length of the housing and supported at its respective ends by bearings 66. The bearings 66 are effectively sealed through annular seals 68 in the same fashion as the bearings 58 are sealed by the outer annular seal 59. The gear housing 44 is filled with a lubricant for permanent lubrication.

The hollow hub 64 is provided with a polygonal coupling section 70, preferably in form of a rounded four-cornered concave polygon located in the region of the drive gear wheel 62 and jutting out from it. Following the coupling section 70, there is located an idle-running section 72 which has a larger diameter and approximately the same or a slightly greater length than the coupling section 70. The coupling section 70 and the idle-running section 72 form a through-channel of the gear housing 44 for inserting the drive shaft 28.

It is significant that the gear 36 includes a drive gear wheel 62 which is supported in the housing 44, and that the drive shaft 54 is provided with the particularly sturdy bearing 58 located approximately in its center section between the end section supporting the cam discs 50, 52 and the axle of the drive wheel 62, so that the assembly constructed from the base plate 38 of the carriage assembly 26 and the gear housing 44 supports all gear elements in their respective exact position, wherein the coupling with the drive shaft 28 is a simple axial plug-in coupling which does not require a high precision, in particular since a polygonal coupling is self-centering even if the coupling elements rotate with respect to each other. As a result, the geometrical axis of the drive shaft 28 is defined by the carriage assemblies 26 arranged in a straight line. The drive shaft 28 itself thus does not require its own bearings in the machine housing, while in the simplest case an unmachined section of a profile section rod which can be purchased by the meter, can be used as drive shaft. It will be understood that the vertical support members 20, 22 of the angular gears 30 depicted in FIG. 6 are also provided with through-channels in the hollow hubs 64, wherein the inside contour of the through-channels matches the contour of the coupling section 70 in the angular gear 36. The drive shafts 28 can then be both inserted and completely removed from the front.

Referring now to FIGS. 9 and 10, the drive shaft 28 includes—between each of two polygonal drive sections 74—an idle-running section 76 which is turned down to a smaller diameter. By axial displacement of the drive shaft 28, an idle-running section 76 can easily be moved close to the coupling section 70 of an angular gear 36, whereby this gear 36 is relieved from the drive train. In the embodiment of FIG. 10, the center gear 36 is not driven while the two outside gears are driven. If the drive shaft 28 is moved in the direction of the arrow, then the two outside gears 36 are stopped, as shown in FIG. 9. In their place, the center gear become operational. FIG. 6 shows adjustable assemblies 78 located at the ends of the machine housing 14 which axially move the drive shafts 28 back and forth in the direction of the arrows—even under program control. Since the carriage assemblies 26 can also be moved along the same direction, a flexible combination for the activation and deactivation of individual gears 36 is provided.

The embodiment of FIG. 7 is distinguished from that of FIG. 6 in that the drive shafts 28 in the horizontal support members 16, 18 are hollow and that a single drive motor 34 drives a main drive shaft located underneath the mounting plate 12, wherein the main drive shaft drives the vertical connecting shafts 32 which in turn rotate the horizontal drive shafts 28 with the help of angular gears. The horizontal drive shafts 28 are driven from both ends. In this embodiment, the vertical support members 20, 22 are also provided with carriage assemblies 26 which are then driven by the connecting shafts 32. The operating direction of these carriage assemblies 26 is thus horizontal. If instead of the fastening holes, fastening slots are provided in the base plates 38 of the carriage assemblies 26, then the carriage assemblies 26 are also capable of operating at an acute angle with respect to the horizontal or vertical direction.

In the embodiment of FIGS. 4 and 5, the machine housing consists only of a horizontal support member 18 with two longitudinal channels 80, with angular gears 36 of the carriage assemblies 26 disposed only in the left channel

80. Each of the carriages 38 carries one tool 82 of a stamping press 84. The drive shaft 28 is driven—as described above—by the drive motor 34 via an angular gear 30, with the drive motor 34 secured to the side of the horizontal support member 18.

In FIG. 8, there is depicted a machine 10 in cross sectional view, wherein both the lower horizontal support member 16 and the upper horizontal support member 18 each carry on their respective front sides and back sides a series of carriage assemblies 26. Each of the two horizontal support members 16, 18 is therefore permeated by two drive shafts 28 which are driven by respective drive motors by way of angular gears located at the ends of the drive shafts 28.

In all embodiments, the longitudinal channels 80 terminate in elongated slots 86 which extend over the length of the horizontal support members 16, 18 and of the vertical support members 20, 22 and have a width which is greater than the dimension of the gear housing 44 measured along that same direction. The drive shaft 28 or its drive section 74, respectively, is represented as a approximately quadratic polygonal profile which is rounded at the corners. In Germany, for example, profiles of this type are standardized under the designation P4C profiles relating to DIN 32712. The invention also comprises equivalent positively locking profile sections such as, for example, spline and multi-spline shafts as well as shafts with keyway and feather key.

I claim:

1. A machine for stamping, bending and assembly of sheet metal parts, comprising:

a machine housing;

a drive shaft supported in the machine housing;

a carriage assembly mounted on the drive shaft and carrying a tool, said carriage assembly having a base plate and an output shaft supporting at least one cam disc and a driven gear wheel;

a plug-type coupling for disengageably securing the carriage assembly to the housing; and a first gear mechanism including a gear housing and an angular gear disposed inside the gear housing for realizing a driving engagement between the output shaft and the drive shaft via the driven gear wheel, said angular gear including a drive gear wheel supported in the gear housing coaxially with the drive shaft, said gear housing forms a unit with the base plate of the carriage assembly, wherein the plug-type coupling is formed between the drive gear wheel and the drive shaft by a non-circular coupling section of the drive gear wheel and a complementary non-circular coupling section of the drive shaft.

2. The machine according to claim 1 wherein the gear mechanism includes at least two of said angular gear, with the drive gear wheels of the angular gears supporting the drive shaft.

3. The machine according to claim 1, and further comprising a second gear mechanism including a drive angular gear disposed on at least one end of the machine housing, said drive angular gear comprising a first gear wheel with a non-circular hub opening of the same shape as a hub opening of the drive gear wheel in the angular gear of the first gear mechanism.

4. The machine according to claim 1 wherein the drive shaft is provided proximate to the coupling section thereof with an idle-running section and is axially moveable relative to the carriage assembly to such an extent that the idle-running section reaches a position previously occupied by the coupling section of the drive shaft, wherein the idle-running section has a greatest radial extent which is smaller than the smallest radial extent of the coupling section of the drive gear wheel.

5. The machine according to claim 4 wherein the drive shaft is so supported as to be moveable in an axial direction.

6. The machine according to claim 1 wherein the drive shaft is so supported as to allow a withdrawal thereof in an axial direction from the machine housing.

7. The machine according to claim 5, and further comprising an adjustable drive mechanism positioned on one end of the drive shaft for moving the drive shaft in the axial direction.

8. The machine according to claim 1, and further comprising a plurality of such carriage assemblies in side-by-side disposition, said the machine housing being formed with at least one longitudinal chamber for accommodating the drive shaft and a portion of the gear housing of each carriage assembly, said longitudinal chamber being accessible through a longitudinal slot formed in a wall of the machine housing and having a width which at least corresponds to a dimension of the gear housing measured in the direction of the width.

9. The machine according to claim 3 wherein the machine housing comprises two horizontal support members in spaced-apart parallel disposition, and two vertical support members for interconnecting the horizontal support members, with each of the horizontal support members supporting such carriage assembly mounted on such drive shaft, said second gear mechanism including two such drive angular gears, with at least one of the vertical support members accommodating one of the drive angular gears at an upper location and the other one of the drive angular gears at a lower location, said two drive angular gears being operatively connectable via the respective drive shaft to the angular gear of the first gear mechanism, each of the drive angular gears of the second gear mechanism having a second gear wheel, and further comprising a connecting shaft for interconnecting second gear wheel of one of the drive angular gears to the second gear wheel of the other one of the drive angular gears.

10. The machine according to claim 1 wherein at least the coupling section of the drive shaft is provided with a rounded multi-cornered polygonal contour.

* * * * *